US007661282B2

(12) United States Patent
Carter et al.

(10) Patent No.: US 7,661,282 B2
(45) Date of Patent: Feb. 16, 2010

(54) HOT FORMING PROCESS FOR METAL ALLOY SHEETS

(75) Inventors: Jon T. Carter, Farmington, MI (US); Paul E. Krajewski, Sterling Heights, MI (US); Ravi Verma, Shelby Township, MI (US); Joshua D. Lasceski, Harrison Township, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 132 days.

(21) Appl. No.: 12/052,781

(22) Filed: Mar. 21, 2008

(65) Prior Publication Data

US 2009/0235708 A1 Sep. 24, 2009

(51) Int. Cl.
*B21D 37/16* (2006.01)
*B21D 26/02* (2006.01)

(52) U.S. Cl. ..... 72/57; 72/60; 72/342.7; 72/342.8; 72/342.94; 72/342.96

(58) Field of Classification Search ..... 72/56, 72/57, 60, 342.7, 342.8, 342.94, 342.96, 72/379.2; 29/421.1
See application file for complete search history.

(56) References Cited

U.S. PATENT DOCUMENTS 2,247,979 A 7/1941 Von Tannenberg
2,385,083 A 9/1945 Kemerer
3,602,024 A 8/1971 Sabroff et al.
3,864,808 A * 2/1975 Doser ..... 72/700
3,926,029 A 12/1975 Abson et al.
3,938,363 A * 2/1976 Kelsey ..... 72/364
4,088,000 A 5/1978 Tomioka et al.
5,218,849 A * 6/1993 Sieger et al. ..... 72/69
5,649,438 A 7/1997 Hall, Jr. et al.
5,749,254 A 5/1998 Hall, Jr.
6,330,818 B1 * 12/2001 Jain ..... 72/42
6,463,779 B1 10/2002 Terziakin
6,550,302 B1 4/2003 Ghosh
6,735,996 B2 * 5/2004 Heussen et al. ..... 72/356
6,807,839 B2 10/2004 Takamatu
6,810,709 B2 11/2004 Hammar et al.
7,165,435 B1 * 1/2007 Schroth et al. ..... 72/364
7,464,572 B2 * 12/2008 Miyanaga et al. ..... 72/58

* cited by examiner

*Primary Examiner*—David B Jones
(74) *Attorney, Agent, or Firm*—Reising Ethington P.C.

(57) ABSTRACT

Magnesium and other metal alloy sheet materials are deformed at hot forming temperatures into vehicle body panels and other articles. Many such hot forming operations are improved in speed and product quality by predetermining a static recrystallization temperature of the sheet material. As the sheet material is being heated to its hot forming temperature, deformation is commenced below the static recrystallization temperature. As heating and deformation are continued, dynamic recrystallization of the workpiece occurs and deformation may proceed faster and to a greater extent.

10 Claims, 3 Drawing Sheets

500μM

500μM

HOT FORMING PROCESS FOR METAL ALLOY SHEETS

TECHNICAL FIELD

This invention pertains to hot forming of magnesium alloy sheets and other metal alloy sheet materials using a predetermined hot forming temperature. More specifically, this invention pertains to practices for commencing deformation of a heated sheet metal workpiece at a selected lower temperature related to its recrystallization temperature and finishing the deformation step at the predetermined hot forming temperature.

BACKGROUND OF THE INVENTION

There is interest in forming relatively light-weight aluminum alloy and magnesium alloy sheet materials into, for example, automotive vehicle body panels. Such panels may be formed from initially flat, sheet metal blanks having nominal dimensions of, e.g., about 1000 mm×1500 mm×1–3 mm. So far, automotive manufacturing engineers have had more experience in forming body panels from aluminum sheet alloys, although magnesium alloys are hot formable at about the same temperature ranges as aluminum alloys and offer further reductions in weight.

The difficulty in forming large, thin panels depends largely on the complexity of the shape of the panel, the severity of the deformation required to be introduced into a sheet metal blank. Some panel shapes, like engine compartment hoods, can often be formed by stamping aluminum alloy sheet blanks between complementary, facing forming dies without preheating the workpieces. One or both of the dies have convex (ram) surfaces that stretch the sheet metal into and against a concave surface on the facing tool. The stamping is carried out at the ambient temperature of the manufacturing site. Other, more complex panel shapes have required that the workpieces be preheated for hot stamping or hot blow forming. Aluminum vehicle lift gates and door panels often require high forming temperatures to deform the sheet material into a decorative and functional panel shape.

Hot blow forming of magnesium or aluminum sheet metal typically involves heating of the sheet to approximately 500° C. in a preheat furnace, robotically transferring that sheet to a position between facing dies which are also heated to approximately that same temperature, clamping the sheet between die halves to establish a gas-tight seal, and then applying gas pressure to one side of the sheet to blow it into a facing die cavity to form the desired shape. Later, the gas pressure is released, the die is opened, and the formed panel is removed and allowed to cool. Alternatively, in some cases, instead of using a preheat furnace, the sheet may be heated by the hot die. In either case, the sheet is typically heated to approximately 500° C., and then held at that temperature for a short time to assure uniform temperature prior to application of the forming pressure. The workpiece typically (if not already fully annealed) undergoes static recrystallization before deformation, and it is the recrystallized grain structure that experiences the deformation. This practice is successfully used with aluminum alloys of suitable composition and thermomechanical history.

In forming by hot stamping, the aluminum or magnesium alloy sheet material is usually preheated to a temperature below about 350° C. and stamped between heated, complementary forming dies carried on opposing press platens and maintained at a specified forming temperature. Again, if the workpiece is not already fully annealed and the preheat temperature is above the static recrystallization temperature, the workpiece will undergo static recrystallization before any deformation. Upon press closure, the heated sheet is contacted by at least one die surface which rams and stretches the sheet against a facing surface. As in hot blow forming, the sheet workpiece and the hot stamping tools are at a specified hot stamping temperature before deformation of the workpiece begins.

These hot forming practices are well developed for aluminum sheet alloys and the fully preheated workpieces are formed readily into body panels of complex shape. But such hot forming of magnesium sheet alloys has generally been slower and more easily applied to the forming of panels with lower shape complexity.

SUMMARY OF THE INVENTION

This invention has been devised for elevated temperature forming of magnesium sheet metal alloys but the sheet metal forming methods may also be applicable to aluminum alloys. The sheet metal alloys are typically about one to three millimeters in thickness.

A magnesium alloy that is widely available in sheet metal forming is the alloy designated AZ31B. The nominal composition by weight of this alloy is about three percent aluminum, one percent zinc, limited amounts of impurities, and the balance magnesium. It is commercially available in the relatively soft, fully annealed, O temper, and in the relatively hard, partially annealed, H24 temper. Practices of the hot forming methods of this invention will be illustrated as applied to AZ31B alloys with 0 temper and H24 temper, but the utility of the invention is not limited to AZ31B materials or even to magnesium alloys.

In a hot forming plant for magnesium alloy sheet material (or other sheet metal material), sheet metal blanks are taken from storage at ambient temperature (e.g., about 18° C. to about 30° C. depending on geographical location and season) and prepared for a designated hot forming operation. Such preparation may include cleaning and lubricant coating of the blanks. A desired forming temperature is pre-specified or predetermined for the composition and temper state of the metal alloy. The forming temperature may, for example, be about 500° C. for hot blow forming or about 350° C. for hot stamping. One or more prepared sheet metal blanks are then heated in preparation for hot forming. In one embodiment, such heating may be accomplished in a pre-heat furnace prior to robotic placement of the blank on heated forming tools. In another embodiment, the blank may be heated by the hot forming tool(s). But, in accordance with this invention, the magnesium alloy blank is not permitted to reach its specified hot forming temperature before deformation of the blank is started. Deformation of the blank is started before the workpiece reaches its static recrystallization temperature. Such initial deformation is used to promote the onset of dynamic recrystallization of the workpiece. Heating and progressive deformation are continued together (in parallel) and hot forming is completed at the specified hot deformation temperature.

In accordance with this invention, it is found that by commencing deformation on a magnesium alloy sheet material before static recrystallization begins, the forming process may be performed more rapidly and greater deformation and product shaping may be attained in the workpiece. By commencing deformation at a predetermined temperature region in the workpiece, dynamic recrystallization, rather than static recrystallization, is initiated at a lower temperature. The dynamically-induced recrystallization continues as heating and deformation are continued during the hot forming of the panel or other article of manufacture. The benefit is that a more complex shape may be formed in the workpiece during a shorter deformation period.

In a practice of the invention a magnesium alloy sheet composition and temper state are selected for hot forming of a body panel or other sheet metal article. In the event a user is not already familiar with the thermo-formability of the material, sheet metal samples may be subjected to suitable heating and forming tests to determine a heating and hot deformation schedule for the material. In the case of hot blow forming of an AZ31B sheet material it may be desired to progressively heat a sheet blank to about 500° C. while commencing deformation, for example, at about 250° C. to about 350° C. By way of example, the total heating period may be about four minutes with forming taking place during the last two minutes. Forming rates in hot blow forming may be managed by control of the rate of application of air pressure (or other fluid pressure) and control of the total pressure during heating of the workpiece. Forming rates in hot stamping may be managed by ram movement at selected temperatures during heating of the workpiece.

Other embodiments and advantages of the invention will be apparent from a detailed description of certain illustrative embodiments.

DESCRIPTION OF PREFERRED EMBODIMENTS

Figure 1:
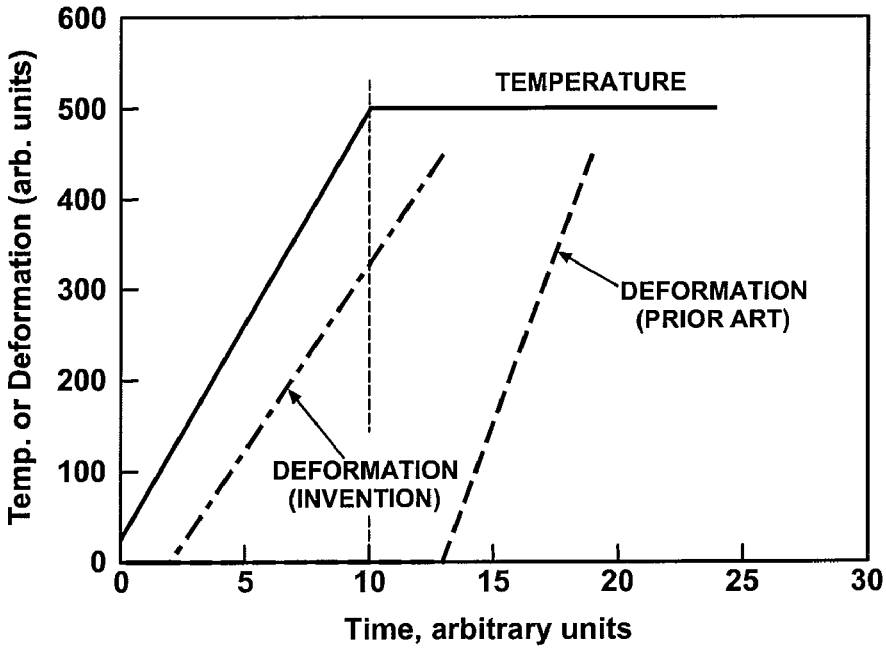
FIG. 1 is a graph illustrating the timing of heating and deforming sheet metal workpieces in accordance with this invention. The y-axis depicts temperature or deformation of the sheet in arbitrary units and the x-axis depicts time in arbitrary units. The workpiece is heated to a predetermined temperature (solid line) and then held at about that temperature. In accordance with the invention (long dash-short dash line), deformation is started before the workpiece is heated to its predetermined temperature. In prior art practices (dashed line) the workpiece is heated to its predetermined temperature before deformation begins.

Traditionally, hot metal forming processes involved heating the workpiece to some elevated temperature, holding it at that temperature for a short time, and then deforming it at that temperature to form a useful shape. This idea is shown schematically (labeled as Prior Art) in FIG. 1 where the workpiece is not subjected to deformation before it has been uniformly heated to its predetermined deformation temperature.

In the subject invention, deformation of the sheet metal workpiece is started before the predetermined deformation temperature is reached. Deformation is continued for some time as the workpiece is heated to its predetermined hot forming temperature. And the final deformation of the workpiece may continue for some time after the maximum or nominal forming temperature is reached, as shown schematically in FIG. 1. In preferred embodiments of the invention, deformation of the workpiece is started at a predetermined temperature before static recrystallization of the workpiece alloy microstructure has commenced. A strategy of the process is to use initial deformation to induce dynamic recrystallization of the workpiece while it is being heated. The heating and deformation are managed to achieve faster and more pronounced shaping in the formed product.

This invention has been demonstrated to be beneficial for hot blow forming of sheets of AZ31B magnesium alloy which is a commercially available and commonly used magnesium alloy sheet. AZ31B material is available in either O temper or H24 temper. The O temper sheet material has a fully annealed microstructure characterized by equiaxed, polygonal grains, free of twins, and having a typical grain size of 5-20 micrometers. The H24 temper sheet has warm worked, partially annealed microstructure characterized by non-equiaxed grains, many twins, and a grain size less than 20 micrometers. The invention will also be beneficial for other hot forming processes, other starting shapes, other alloys, and other tempers.

One example of the use and benefits of this invention is illustrated by the (unconstrained) hot blow forming of AZ31B-O sheet into hemispherical domes. In this work, a blank at room temperature is placed in a die which is maintained at a forming temperature such as 450° C. One face of the sheet is placed to overlie a circular 100 mm diameter opening in a die plate and the sheet is heated by the hot die. When the sheet reaches a suitable temperature, gas pressure is applied to the other side of the sheet to expand the sheet through the hole into an unconstrained dome shape. The gas pressure may be increased in stages or applied at a predetermined pressure level.

Figure 2A:
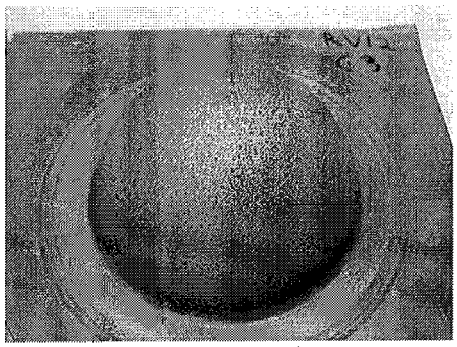
FIG. 2A is a photograph of a hemispherical dome blown into AZ31B sheet material by a prior art practice of heating the sheet metal in a die to 450° C. before applying air pressure to a side of the heated blank to hot blow form the dome shape.
Figure 2B:
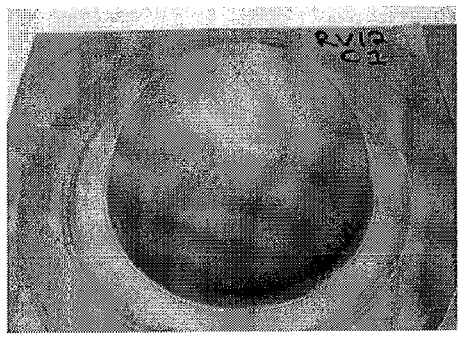
FIG. 2B is a photograph of a hemispherical dome blown into AZ31B sheet material by a practice of this invention of heating the sheet metal in a die at 450° C. but applying air pressure to a side of the heated blank when its temperature reaches 250-300° C. Heating and deformation of the blank continues to hot blow form the dome shape.

In a first example with an AZ31B-O workpiece the gas pressure was applied and deformation commenced only after the sheet reached 450° C. The forming of the dome was slow requiring 24 minutes at an air pressure of 75 psi. The height of the dome was relatively short (49 mm) when splitting occurred, and the dome surface was very rough. This first dome is illustrated in the photograph of FIG. 2A. If, instead, gas pressure is applied and deformation is commenced when the blank temperature is approximately 300° C., the dome forms faster (19 minutes), is taller (59 mm), and is smoother. This higher and smoother dome is shown in the photograph of FIG. 2B.

Figure 3A:
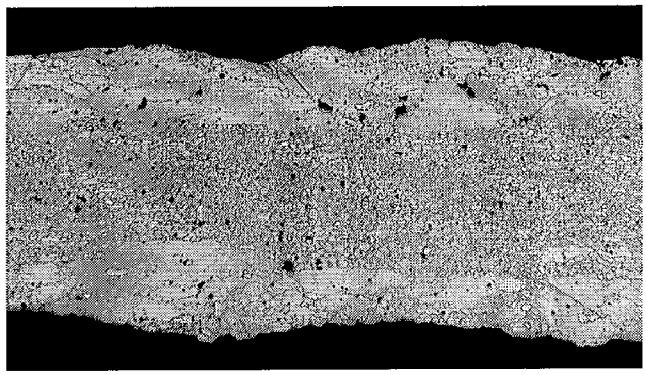
FIG. 3A is photomicrograph of a cross-section of the AZ31B material of the dome shown in FIG. 2A.
Figure 3B:
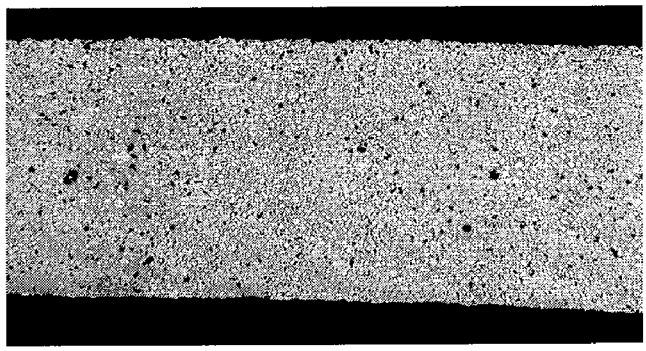
FIG. 3B is photomicrograph of a cross-section of the AZ31B material of the dome shown in FIG. 2B.

These differences in dome forming are due to the different microstructures, especially the grain sizes, which develop during heating and as the blank are being formed. In the case of the FIG. 2A dome, static recrystallization occurred near the sheet surfaces before sheet deformation began. This resulted in very large surface grains which (a) limited the maximum achievable dome height (by splitting), (b) slowed deformation, and (c) caused surface roughening. In the case of the FIG. 2B dome, recrystallization occurred during deformation, resulting in finer grains. The microstructures of sections of the FIG. 2A dome and FIG. 2B dome are shown in the photomicrographs of FIGS. 3A and 3B, respectively. FIG. 3A illustrates the rougher surface and larger grains of the sheet heated to 450° C. before gas pressure was applied to form the dome of FIG. 2A. FIG. 2B illustrates the microstructure of the AZ31B-O sheet that experienced dynamic recrystallization when gas pressure was applied when the blank temperature was 250-300° C.

An embodiment of the invention was then practiced in a manufacturing plant using production tooling for hot blow forming of AA5083 alloy sheet materials which display high formability at temperatures of 970° F. (about 500° C.). The hot blow forming practice is described in U.S. Pat. No. 6,253,588, titled Quick Plastic Forming of Aluminum Alloy Sheet Metal, and assigned to the assignee of this invention. The disclosure of the '588 patent is incorporated herein by reference for the purpose of a more complete disclosure of such hot blow forming as practiced with aluminum alloy sheet stock.

Figure 4:
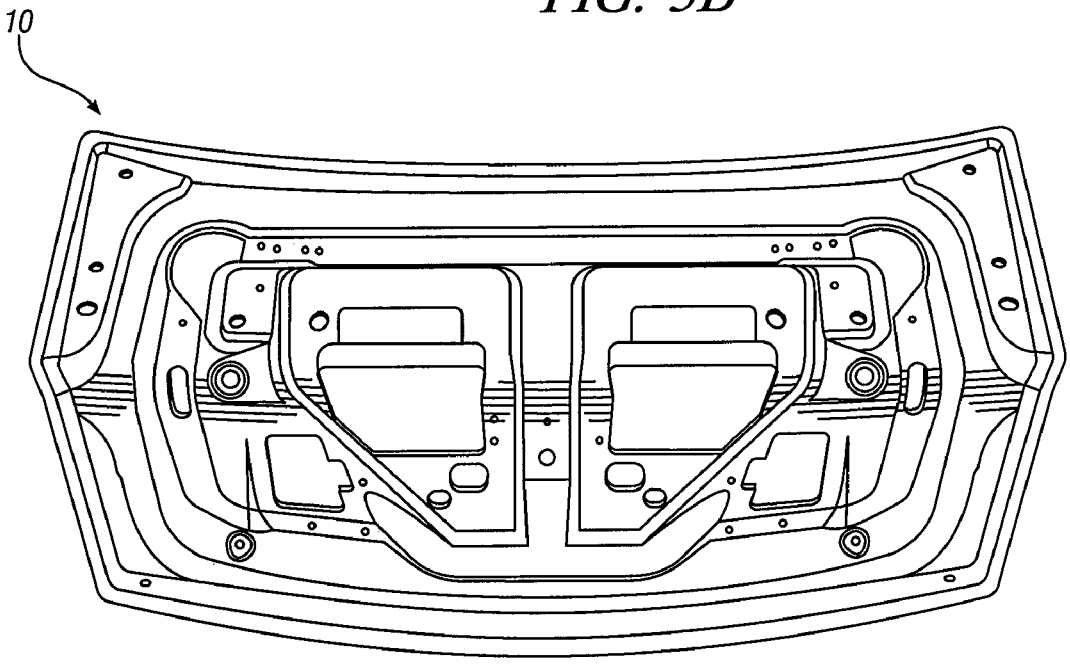
FIG. 4 is an oblique view of a vehicle decklid inner panel made by hot blow forming of an AZ31B-H24 sheet. The view is of the formed decklid panel after it was trimmed and pierced.

In Quick Plastic Forming (QPF) the sheet metal is heated to a hot forming temperature and stretched under the pressure of a working gas into conformance with the surface of a forming tool. In the following experiments AZ31B-H24 sheet blanks were heated and working gas pressure was applied as specified in following paragraphs. AZ31B-H24 sheet blanks were formed into decklid inner panels of complex shape as illustrated in FIG. 4. The formed and trimmed decklid inner panel 10 is curved to cover top and rear walls of a vehicle trunk. The peripheral edge of an inner panel 10 is shaped to be attached to an overlying, similarly shaped edge of an outer panel. The inner panel 10 is shaped with depressions and openings to hold wiring and the like, and to provide access between it and an outer panel to which it is attached.

AZ31B-H24 sheet blanks were heated in a separate preheat furnace prior to placing them in the QPF production die, which was heated to approximately 970° F.

Figure 5:
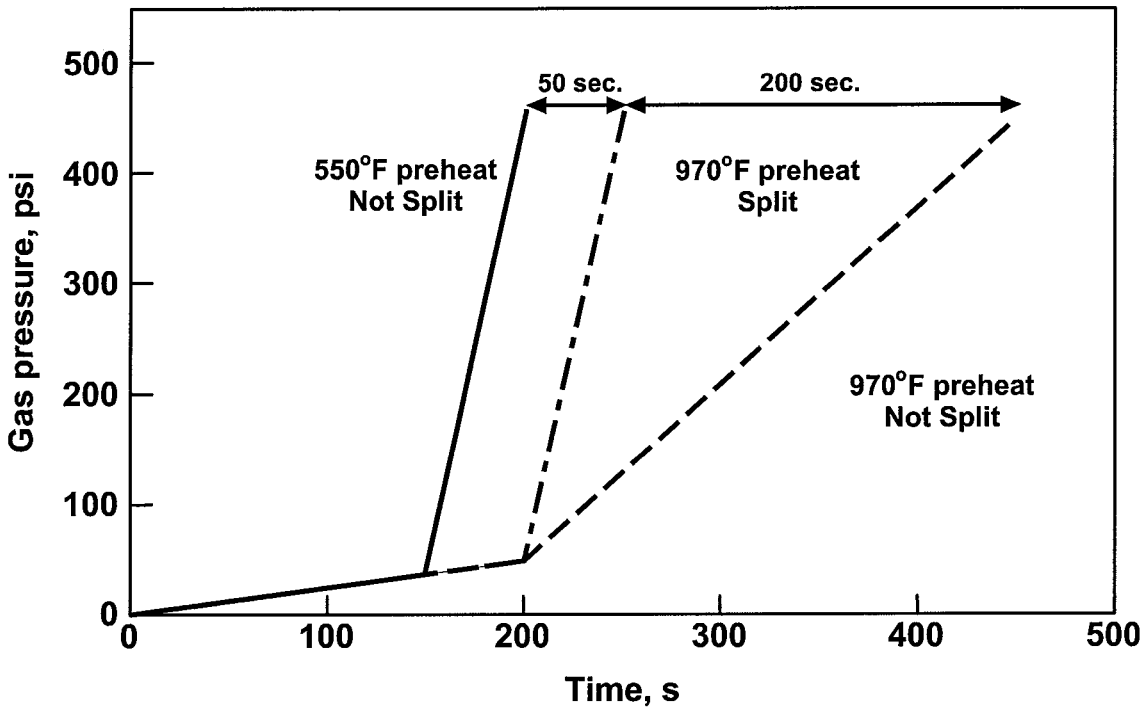
FIG. 5 is a graph depicting different hot blow forming practices with variations in the application of gas pressure with time in making a decklid as depicted in FIG. 4. The graph depicts three different gas pressures (in psi) versus time (in seconds) sequences in forming three different decklid inner panels.

A first group of AZ31B-H24 sheet blanks were heated individually to 970° F. in the pre-heater and hot blow formed one at a time in the production QPF tooling. With each blank of this group, the working gas (air) pressure on the fully heated blank was increased over a period of 450 seconds as illustrated in the equal length dashes linear curve of FIG. 5. As seen in the equi-dashed curve of FIG. 5, the air pressure in each case was increased linearly over about 200 seconds to about 50 psi. Then, the air pressure was increased linearly to about 450 psi over the next 250 seconds. This hot forming practice produced good (un-split) panels using the 450-second pressurization schedule on fully heated blanks.

A second group of AZ31B-H24 sheet blanks fully preheated to 970° F. was subjected to a faster air pressurization cycle of 250-second duration. Again, the air pressure was first increased slowly over 200 seconds to about 50 psi. Then, the air pressure was increased to 450 psi over the next 50 seconds (short dash, long dash line in FIG. 5) to complete formation of the magnesium decklid panels. This practice yielded unacceptable panels with splits in deformed regions of the workpieces.

A third group of AZ31B-H24 sheet panels were formed in accordance with this invention. These magnesium alloy blanks were preheated to just 550° F. before they were placed in the hot QPF tools. As each blank was being further heated to 970° F. by the tools, air pressure was applied and increased to about 40 psi over 150 seconds (solid line). The air pressure was then rapidly increased to 450 psi over the next 50 seconds. Good panels were formed in 200 seconds. Therefore, use of this invention reduced the forming cycle time by at least 50 seconds and maybe up to 250 seconds. Also, the lower pre-heater temperature results in direct energy savings, longer element life, and less waste heat in the plant.

It will often be preferred to examine a type of batch of sheet metal material to estimate or predetermine a hot working temperature and a lower temperature at which deformation is to be commenced in accordance with this invention to induce dynamic recrystallization. This analysis may be applied to magnesium alloys such as AZ31B-O temper, AZ31B-H24 temper, other magnesium alloys, aluminum alloys or the like. Usually it may be desired to determine the static recrystallization temperature of the material. This temperature may differ even with materials of the same composition and temper condition. For example, AZ31B-O temper sheet materials may have slightly different static recrystallization temperatures because of varying amounts of residual cold work stress resulting from handling or processing of the rolled sheet material.

As related to the present invention, the static recrystallization temperature of metal sheet may be determined by heat treating several representative samples and then examining cross sections of those treated samples metallographically. It is normally preferred that the heat treating should be done at several selected temperatures, all below the nominal hot-forming temperature. It is preferred that the heating rate in testing be similar to that which will be used in the actual hot forming manufacturing process. Typically, each sheet metal sample should be held at its selected heat treat temperature for approximately one minute, then removed from the furnace and allowed to cool. A cross-sectional metallographic sample of each should be prepared and examined in a microscope to observe the grains. Samples heat treated at temperatures below the static recrystallization temperature will show a grain structure essentially identical to un-treated samples. Samples heat treated at or above the static recrystallization temperature will show grains which are largely equiaxed, polygonal, and free of evidence of 'cold work', i.e., dislocations and/or twins. In some materials, static recrystallization might not occur uniformly through the sheet thickness. i.e., it may occur near the sheet surfaces, but not near the mid-plane of the sheet sample. In other words, such static recrystallization may not be occurring in a significant portion of the sheet material so as to be used in determination of the static recrystallization temperature. It is prudent for the observer to note this because such recrystallization may strongly affect both the formability and surface finish of hot-formed articles.

For the purpose of determining static recrystallization temperature of AZ31B magnesium alloy sheet, heat treating temperatures of 200, 225, 250, 275, 300, 325, and 350° C. are recommended.

Such testing will typically reveal a temperature in the heating of like workpieces at which hot forming process deformation is to be commenced. Of course, heating to the specified hot working temperature for the sheet material is continued as deformation to a desired shape is continued.

Practices of the invention have been illustrated by specific examples. But the scope of the invention is not limited by the specific examples.

The invention claimed is:

1. A method of progressively deforming a polycrystalline sheet metal workpiece into an article shape when the workpiece must be heated to a predetermined hot forming temperature so that the portions of the sheet metal workpiece can sustain deformation required to attain the shape of the article, the method comprising:

predetermining for the sheet metal material a static recrystallization temperature at which a significant portion of the sheet metal upon heating to its hot forming temperature will start recrystallization; and, thereafter, during hot forming of like sheet metal workpieces progressively heating the sheet metal workpiece to its recrystallization temperature and further to its hot forming temperature;

commencing deformation of the heated workpiece before it reaches its recrystallization temperature to induce dynamic recrystallization in the workpiece; and continuing heating of the workpiece to its hot forming temperature while continuing deformation of the workpiece to its intended shape.

2. A method of progressively deforming a polycrystalline sheet metal workpiece as recited in claim 1 in which the sheet metal material is a magnesium alloy.

3. A method of progressively deforming a polycrystalline sheet metal workpiece as recited in claim 1 in which the sheet metal material is an aluminum alloy.

4. A method of progressively deforming a polycrystalline sheet metal workpiece as recited in claim 1 in which the workpiece is deformed by hot blow forming.

5. A method of progressively deforming a polycrystalline sheet metal workpiece as recited in claim 1 in which the workpiece is deformed by hot stamping.

6. A method of progressively deforming a polycrystalline magnesium alloy sheet workpiece into an article shape when the workpiece must be heated to a predetermined hot forming temperature so that the portions of the magnesium alloy sheet workpiece can sustain deformation required to attain the shape of the article, the method comprising:

predetermining for the magnesium alloy sheet material a static recrystallization temperature at which a significant portion of the sheet metal upon heating to its hot forming temperature will start recrystallization; and, thereafter, during hot forming of like sheet metal workpieces progressively heating the magnesium alloy sheet workpiece to its recrystallization temperature and further to its hot forming temperature;

commencing deformation of the heated workpiece before it reaches its recrystallization temperature to induce dynamic recrystallization in the workpiece; and continuing heating of the workpiece to its hot forming temperature while continuing deformation of the workpiece to its intended shape.

7. A method of progressively deforming a polycrystalline magnesium alloy sheet workpiece as recited in claim 6 in which the magnesium alloy is AZ31B alloy.

8. A method of progressively deforming a polycrystalline magnesium alloy sheet workpiece as recited in claim 6 in which deformation of the heated workpiece is commenced at a workpiece temperature of about 250-350° C. and completed above 350° C.

9. A method of progressively deforming a polycrystalline magnesium alloy sheet workpiece as recited in claim 6 in which the workpiece is deformed by the application of pressurized working gas against a side of the sheet workpiece, and the rate deformation of the heated workpiece is controlled, at least in part, by controlling the pressure of the working gas throughout workpiece deformation.

10. A method of progressively deforming a polycrystalline magnesium alloy sheet workpiece as recited in claim 6 in which the workpiece is deformed by the exertion of a ram tool against a side of the sheet workpiece, and the deformation rate of the heated workpiece is controlled, at least in part, by controlling the movement of the ram tool throughout workpiece deformation.

* * * * *